United States Patent [19]

Weber et al.

[11] 4,114,284

[45] Sep. 19, 1978

[54] SACHETS PARTICULARLY FOR USE IN CLOTHES DRIERS

[75] Inventors: Rudolf Weber, Dusseldorf-Holthausen; Winfried Pochandke, Dusseldorf-Garath; Karl Schwadtke, Opladen, all of Germany

[73] Assignee: Henkel Kommanditgesellschaft auf Aktien, Dusseldorf-Holthausen, Germany

[21] Appl. No.: 762,254

[22] Filed: Jan. 25, 1977

[30] Foreign Application Priority Data

Feb. 2, 1976 [DE] Fed. Rep. of Germany ..... 2603823

[51] Int. Cl.[2] ..... F26B 7/00

[52] U.S. Cl. ..... 34/12; 239/55; 239/56

[58] Field of Search ..... 34/12, 60; 239/55, 56

[56] References Cited

U.S. PATENT DOCUMENTS

| | | | |
|---|---|---|---|
| 2,435,096 | 1/1948 | Peterson | 239/55 |
| 3,706,140 | 12/1972 | Brillaud et al. | 34/60 |
| 3,858,807 | 1/1975 | Rabussier et al. | 239/56 |
| 3,947,971 | 4/1976 | Bauer | 34/60 |
| 4,004,685 | 1/1977 | Mizuno et al. | 239/55 |
| 4,014,105 | 3/1977 | Furgal et al. | 34/12 |

*Primary Examiner*—John J. Camby

*Attorney, Agent, or Firm*—Hammond & Littell

[57] ABSTRACT

A sachet consisting of a closed packet of a semipermeable to gas plastic film containing an odor-producing composition of a fragrant nature absorbed on an inert absorbent carrier, particularly for use in household clothes driers.

9 Claims, 2 Drawing Figures

FIG. 1
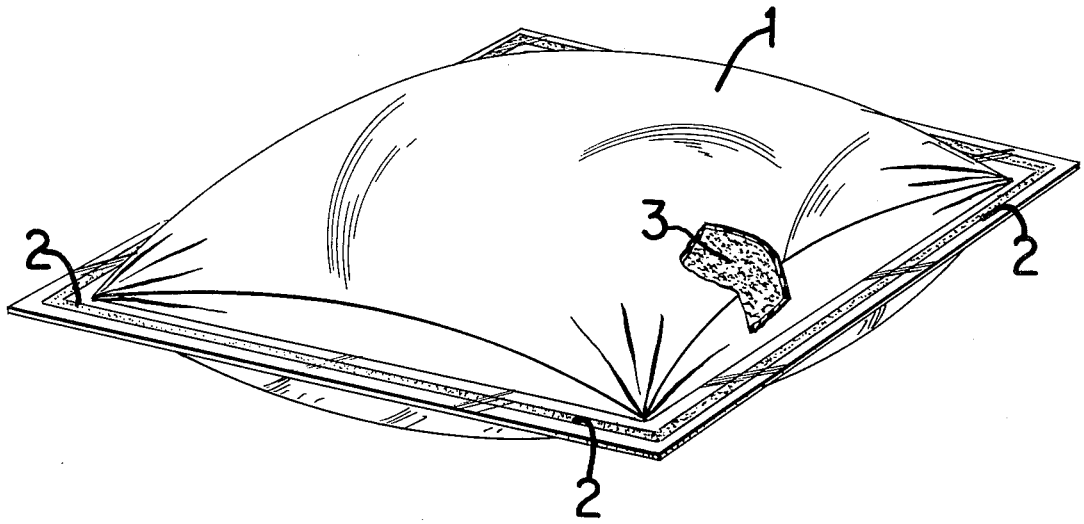
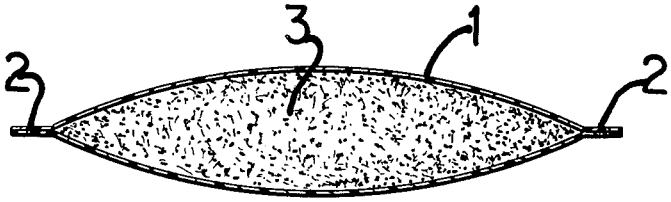
FIG. 2

SACHETS PARTICULARLY FOR USE IN CLOTHES DRIERS

STATE OF THE ART

The number of driers in private households is constantly increasing because of the savings in time and space achieved with these appliances compared to the conventional drying of laundry on clothes lines. Machines for drying have, therefore, been used for a long time in industrial laundries. But this type of drying has the disadvantage that the dried laundry does not have the fresh pleasant odor known from laundry which has been dried in fresh moving air. This is particularly true for driers working without ventilation and for the so-called condensation type driers which work with a closed air circulation. The damp and musty odor generally found in laundry coming from these driers is, therefore, felt by the user as unpleasant and annoying. Freshly washed damp laundry has at first a pleasant fresh odor, due to the perfume in the washing agent. In addition, a perfumed soft rinse, which is used in the last rinse cycle of the washing machine, can impart a stronger odor to the laundry. But the odor of the freshly washed damp laundry treated this way is soon lost in the subsequent drying in the drier. Besides, all pieces of the laundry are equally perfumed in the last rinsing bath and hence those pieces also where perfuming is not desired, for example, dish towels.

Since sorting out laundry before washing with reference to subsequently desired or undesired perfuming is not feasible, separate perfuming of certain laundry pieces is not possible in the present washing process by subsequent after-treatment in the last rinsing bath. The present invention now offers the possibility of avoiding these inconveniences by the use of a sachet.

OBJECTS OF THE INVENTION

An object of the present invention is the development of a sachet particularly suitable for the treatment of laundry in the drier.

Another object of the present invention is the development of a sachet consisting of a closed packet of a semi-permeable-to-gas plastic film containing an odor-producing composition of a fragrant nature absorbed on an inert absorbent carrier, particularly for use in household clothes driers.

These and other objects of the present invention will become more apparent as the description thereof proceeds.

THE DRAWING

FIG. 1 is a plan view of the sachet of the invention.

FIG. 2 is a cross-section of the sachet of the invention.

DESCRIPTION OF THE INVENTION

The sachet according to the invention consists of a closed bag of plastic film, which contains an odorous substance or odor-producing composition of a fragrant nature, preferably together with an inert absorbent carrier. Suitable as a covering material for the sachet are principally all types of semi-permeable-to-gas plastic films, which are stable and inert under the conditions of a drier, that is, at temperatures of up to about 100° C. The thickness of the film can vary within wide limits, depending on the type of plastic. It was found that with proper selection of the plastic and its thickness, the sachet gives off only a small amount of odorous substances when stored at room temperature, but at higher temperatures, that is, in the range of 35° C. to 100° C., particularly under the operating conditions of a drier, that is, at temperatures of about 60° C., a controlled delivery of odorous substances is possible because of the then greater permeability. Particularly surprising was the observation that a substantial part of the odorous substance found subsequently in the laundry is given off in the drier in the cold phase which follows the hot phase of laundry drying.

More particularly, the present invention relates to a sachet consisting of a closed packet of a semi-permeable-to-gas plastic film containing an odor-producing composition of a fragrant nature absorbed on an inert absorbent carrier, particularly for use in household clothes driers.

The semi-permeable-to-gas plastic films with a thickness of 0.05 to 0.15 mm are preferred, especially those of polyethylene of the above thickness. In addition, a paper-lined plastic film which is semi-permeable-to-gas may also be used as a covering or enveloping material without impairing the permeability of the odor-producing composition of a fragrant nature. Paper lining, where the paper forms the outside of the sachet of the invention and the plastic film is polyethylene, is preferred for the mechanical production of large quantities of sachets.

The sachet contains the odorous substance or odor-producing composition of a fragrant nature preferably on an inert absorbent carrier material. Suitable carrier materials are fleeces, for example, of polyamide, PVC or viscose, as well as textile materials, felt, paper, solid foams, sponges, etc. Fleeces are the preferred carrier material, which are then cut to the size of the sachet. This way, flat sachets which are welded on all sides can be obtained, which are moved by the drum of the drier uniformly between pieces of laundry. If a stronger fragrance is desired, the drier can be readily loaded with several sachets.

The odorous substance can be used in pure form, as an alcohol solution, or as an aqueous emulsion. Preferably the odorous substance is used as a perfume oil-emulsion, that is, as a mixture of perfume oil, water and an emulsifier. In this way, the desired amount of odorous substance can be applied easily and uniformly during the manufacture of the sachet.

All perfumes which give off the desired fragrance and which are stable under the conditions of use are suitable as odorous substances or odor-producing compositions of a fragrant nature.

The shape of the sachet is preferably rectangular, particularly square, with side lengths of 5 to 30 cm and a weight of 5 to 20 gm.

The film pieces forming the sachet are preferably joined with each other by welding. Other types of closing the sachet are by sewing or tying with a string, clamping with metal wire or a plastic loop, etc., particularly when the sachet of the invention has the form of a small bag.

The sachet according to the invention serves particularly to impart to the laundry in the drier fresh odor. To accomplish this, the sachet is added to the damp laundry in the drum of the drier where it gives off fragrance to the laundry during the drying process. The invention thus also concerns a method for treating the laundry in the drier. This method is characterized in that a sachet of the above-described type is placed together with the damp laundry in a drier where it acts on the laundry during the drying process.

Due to this treatment, the laundry is uniformly perfumed in a controlled manner with a certain individually selected fragrance in the desired intensity. During the treatment of the laundry with the sachet according to the invention, other desired properties can be imparted to the laundry by adding, for example, textile softeners or antistatic agents. A sachet can be used repeatedly in the drier until the odorous substance is exhausted therefrom.

In the application of the sachet according to the invention, use is made of the temperature-dependent permeability to odorous substances of the plastic films used as a sachet cover. In addition to the above-described and particularly preferred use in laundry driers, the sachet according to the invention can be used wherever a long-lasting perfuming effect is desired. Thus, the sachet according to the invention is suitable for perfuming bath tub water or the cleaning liquors for dish washing. By applying the sachet to heaters or outlet openings for fresh air in heated or air-conditioned rooms or in vehicles, the room air is perfumed. Finally, a sachet can be placed between laundry pieces stored at room temperature or can be worn next to the body in underwear. Because of the reduced permeability of the film cover at lower temperatures, the odorous substance escapes over a longer period of time.

The sachet according to the invention is also suitable to eliminate or mask unpleasant odors caused by dirty objects and waste stored in storage containers, for example, hoppers for dirty linen, garbage cans or dishwashing machines filled with dirty dishes. For these applications sachets can also be used which have already been used in the drier and still contain a small amount of the original odorous substance.

The sachet according to the invention can be further described by the drawings. Two sheets of plastic film 1 of rectangular to square shape are filled with an inert absorbent material 3 to which the odorous substance (not shown) is applied. Thereafter the two sheets of plastic film 1 are welded along weld line 2.

The invention will be described more fully in the following examples which are not limitative in any respect.

EXAMPLE 1

Manufacture of a Sachet From Polyethylene Film

A sachet was produced from two layers of a polyethylene film 15 × 15 cm with a thickness of 0.08 mm, a polyamide fleece (having a weight per square meter of about 150 gm) 12.5 × 12.5 cm, and 4 gm of a 40% perfume oil-emulsion. The perfume oil-emulsion consisted of 40% of a perfume oil of a fragrance which can be described as "flowery fancy lavender with a radiant fresh headnote," 10% of a fatty alcohol polyoxyethylene/polyglycol ether, for example, coconut fatty alcohol + 4 mols of ethylene oxide, and 50% by weight of water. The perfume oil used had the following composition:

| | Percent by Weight |
|---|---|
| Lavender oil 40/42% | 350 |
| Lavendin oil 30/32% | 280 |
| Italian lemon oil | 100 |
| Rosemary oil | 80 |
| Geranium oil | 50 |

-continued

| | Percent by Weight |
|---|---|
| Terpineol (perfumery) | 50 |
| α-hexyl cinnamaldehyde | 50 |
| Patchouli oil Karimun | 20 |
| Ketone musk | 20 |

After 4 gm of the perfume oil-emulsion had been applied evenly on the fleece 3, it was welded along weld lines 2 between the polyethylene film sheets 1.

EXAMPLE 2

Drying Method 3.2 kg of freshly washed laundry, residual moisture 90%, which had been washed first at 95° C. with a perfumed all-temperature detergent, was dried together with the sachet of Example 1 in a household laundry drier of the rotating drum type. The total duration of the drying process was 75 minutes. Of these, 5 minutes were required for heating to 60° C., 45 minutes for the hot phase (circulating air at 60° C.), and the last 15 minutes for the cold phase (cooling by injecting cold air). The weight of the sachet before use was 9.34 gm; after use, it was 9.19 gm, a loss of 0.15 gm of odorous substance.

The odor of the dried laundry was judged by five judges according to the following grades:

Grade
- 0 = No perfume odor
- 1 = Weak perfume odor
- 2 = Pronounced perfume odor
- 3 = Strong perfume odor
- 4 = Very strong perfume odor.

The average values from the five evaluations are indicated in the following Table.

TABLE

Evaluation of Odor of Laundry Dried in the Drier

| | Grade |
|---|---|
| Without a sachet of Example 1, directly after drying | 0 |
| With a sachet of Example 1, directly after drying | 2.4 |
| With open storage of laundry dried together with a sachet of Example 1, after 48 hours | 1.2 |
| With storage in a closed closet of laundry dried together with a sachet of Example 1, after 48 hours | 1.6 |
| With storage of laundry, dried without a sachet, in a closed closet together with a new sachet of Example 1, after 48 hours | 3.8 |
| After 6 weeks | 3.1 |
| With storage of laundry, dried without a sachet, in a closed closet together with a sachet of Example 1 used once in drier, after 48 hours | 3.2 |
| After 6 weeks | 2.7 |

EXAMPLE 3

Production of a Sachet From a Paper-Lined Polyethylene Film

The film material employed was a polyethylene film of 40 gm/m$^2$ which was lined with a moisture- and abrasion-resistant white paper of 50 gm/m$^2$. For the production of the sachet, two layers 10 × 10 cm were welded with each other, with the side with the polyethylene film to the inside. The welding seam was 0.5 to 0.8 cm width. The carrier for the odorous substance utilized was a paper fleece of 86 gm/m$^2$ with a size of 20 ×

20 cm which when folded into nine layers had a size of about 7 × 7 cm and which was saturated with 4 ml of the perfume oil-emulsion described in Example 1. The finished sachet weighed 9.4 gm.

This sachet with a paper-lined film can be produced in a very short time and is particularly suitable for series production with automatic film welding machines.

When such a fragrant sachet is placed in a household drier with a charge of 3.2 kg freshly washed laundry, as described in Example 1, the fragrance grades obtained directly after drying and also after the storage of the laundry are comparable to those of Example 1. The weight of the sachet after one use was 9.0 gm, a loss of 0.4 gm of odorous substance.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. The method of drying and scenting damp washed laundry consisting of mechanically tumbling the same in an enclosed zone while passing hot air therethrough at a temperature of from 35° C. to 100° C. for a time sufficient to dry the same in the presence of a sachet consisting of a closed packet of a semi-permeable-to-gas polyethylene film having a greater permeability to gas at temperatures in the range of 35° C. to 100° C., than lower temperatures, containing an odor-producing composition of a fragrant nature absorbed on an inert absorbent carrier, and thereafter cooling said hot dry and scented laundry.

2. The sachet of claim 1, wherein said plastic film has a thickness of from 0.05 to 0.15 mm.

3. The sachet of claim 1 wherein said odor-producing composition is a perfume oil-emulsion.

4. The sachet of claim 3 wherein said perfume oil-emulsion contains from 25% to 50% by weight of perfume oils.

5. A sachet for use in household clothes driers consisting of a welded-closed packet of polyethylene film having a thickness of from 0.05 to 0.15 mm said polyethylene film being semi-permeable-to-gas and having a greater permeability to gas at temperatures in the range of from 35° C. to 100° C., than at lower temperatures, containing a perfume oil-emulsion containing from 25% to 50% of perfume oils, absorbed on an inert absorbent carrier, said closed sachet being flat and rectangular with side lengths of 5 to 30 cm and a total weight of 5 to 20 gm.

6. The sachet of claim 5 wherein said inert absorbent carrier is selected from the group consisting of fleeces, textile materials, felt, paper, solid foams and sponges.

7. The sachet of claim 5 wherein said closed packet is a square.

8. The sachet of claim 5 wherein said inert absorbent carrier is a flat polyacrylamide fleece.

9. The sachet of claim 5 wherein said polyethylene film is paper lined where the paper is permeable-to-gas and on the outside of said sachet.

* * * * *